US009295861B2

(12) United States Patent
Trapp et al.

(10) Patent No.: US 9,295,861 B2
(45) Date of Patent: Mar. 29, 2016

(54) MECHANICAL REMOTE MONITOR CONTROL

(71) Applicant: ELKHART BRASS MANUFACTURING COMPANY, INC., Elkhart, IN (US)

(72) Inventors: James M. Trapp, Galien, MI (US); Douglas B. Kelley, Schuylkill Haven, PA (US)

(73) Assignee: Elkart Brass Manufacturing Company, Inc., Elkhart, IN (US)

( * ) Notice: Subject to any disclaimer, the term of this patent is extended or adjusted under 35 U.S.C. 154(b) by 297 days.

(21) Appl. No.: 13/780,249

(22) Filed: Feb. 28, 2013

(65) Prior Publication Data

US 2014/0209329 A1 Jul. 31, 2014

Related U.S. Application Data

(60) Provisional application No. 61/759,226, filed on Jan. 31, 2013.

(51) Int. Cl.
*A62C 31/24* (2006.01)
*A62C 31/28* (2006.01)

(52) U.S. Cl.
CPC ..... *A62C 31/24* (2013.01); *A62C 31/28* (2013.01)

(58) Field of Classification Search
CPC ..... A62C 13/78; A62C 27/00; A62C 31/24; B05B 15/08
USPC ..... 239/159, 166, 587.3, 587.4, 587.5, 239/587.6, 588, 393, 394, 395, 396, 397, 239/398, 587, 587.2, 287.5; 169/51, 52, 25, 169/24, 29, 40, 54, 56, 60; 254/393–398
See application file for complete search history.

(56) References Cited

U.S. PATENT DOCUMENTS

| | | | | |
|---|---|---|---|---|
| 35,601 | A | 6/1862 | Fobes et al. | |
| 703,115 | A | 6/1902 | Cook et al. | |
| 927,837 | A | 7/1909 | Delene | |
| 1,468,998 | A | 9/1923 | Dolan | |
| 2,698,665 | A * | 1/1955 | Freeman | A62C 99/009 169/25 |
| 3,160,347 | A * | 12/1964 | Ackley | A01M 7/0053 169/24 |
| 3,206,126 | A | 9/1965 | Thompson | |
| 3,587,872 | A * | 6/1971 | Pauly | 414/732 |
| 3,770,062 | A * | 11/1973 | Riggs | 169/24 |
| 3,840,074 | A * | 10/1974 | Clark | 169/24 |
| 3,840,474 | A * | 10/1974 | Clark | B01J 37/20 502/219 |
| D479,314 | S | 9/2003 | Trapp | |
| 7,191,964 | B2 | 3/2007 | Trapp | |
| 7,243,864 | B2 | 7/2007 | Trapp et al. | |
| 2010/0274397 | A1 * | 10/2010 | Lozier | G05D 7/06 700/283 |

* cited by examiner

*Primary Examiner* — Arthur O Hall
*Assistant Examiner* — Christopher R Dandridge
(74) *Attorney, Agent, or Firm* — Faegre Baker Daniels LLP

(57) ABSTRACT

A system and method remotely mechanically controls the direction of fluid flow from a firefighting monitor. For example, a control handle mounted in the cabin of a vehicle can be operably mechanically coupled to a pivotable firefighting monitor mounted outside the vehicle (e.g., near the front) by an arrangement of cables. The handle and cables are arranged such that horizontal pivoting of the handle results in a corresponding horizontal pivot of the firefighting monitor, and vertical pivoting of the handle results in a corresponding vertical pivot of the firefighting monitor. The direct mechanical link between the handle and firefighting monitor ensures a rapid and reliable control over the monitor direction and orientation, while providing an intuitive and user friendly operational modality.

31 Claims, 11 Drawing Sheets

MECHANICAL REMOTE MONITOR CONTROL

CROSS REFERENCE TO RELATED APPLICATIONS

The present application claims the benefit under Title 35, U.S.C. Section 119(e) of U.S. Provisional Patent Application Ser. No. 61/759,226, filed Jan. 31, 2013 and entitled MECHANICAL REMOTE MONITOR CONTROL, the entire disclosure of which is hereby expressly incorporated herein by reference.

BACKGROUND

1. Field of the Disclosure

The present disclosure relates to an apparatus and method for dispersing firefighting fluid. More particularly, the present disclosure relates to a firefighting monitor which is remotely mechanically controllable by an operator.

2. Description of the Related Art

Firefighting monitors are aimable, controllable high-capacity devices used for directing a stream of water or other firefighting fluid in a desired direction. For example, some vehicle-mounted firefighting monitors are sized to deliver a fluid flow volume between about 60-200 US gallons/minute, while "master stream" firefighting monitors are typically mounted to a fixed installation or vehicle and may deliver a fluid flow volume between 350-2,000 US gallons/minute or greater.

In some cases, it is desirable to position a firefighting monitor at a location remote from the monitor's operator. For example, in some cases a firefighter may wish to direct the stream of fluid flow from a position of greater safety, such as in the cabin of a vehicle or in a protected enclosure near a permanently installed monitor (such as near high-risk areas at an oil facility). To avoid the necessity for the firefighter to leave the vehicle or enclosure to manually adjust or manipulate a firefighting monitor, a remote control system may be provided so that the operator may maintain effective control over the monitor functions from a safe location.

Existing remote control firefighting monitor systems utilize electronic communication between operator controls and the remotely located firefighting monitor. Such systems may use an arrangement of electric motors which are remotely actuatable by user controls via a wireless connection (e.g., a radio frequency transmitter and receiver). One exemplary electric remote controlled firefighting monitor is the Sidewinder EXM System available from Elkhart Brass Manufacturing Company, Inc. of Elkhart, Ind., USA. Another exemplary system for electronic remote control of firefighting monitors is disclosed in U.S. Patent Application Publication No. 2010/0274397, filed Apr. 21, 2010 and entitled FIREFIGHTING MONITOR AND CONTROL SYSTEM THEREFOR, the entire disclosure of which is hereby expressly incorporated by reference herein.

SUMMARY

The present disclosure provides a system and method for remotely mechanically controlling the direction of fluid flow from a firefighting monitor. For example, a control handle mounted in the cabin of a vehicle can be operably mechanically coupled to a pivotable firefighting monitor mounted outside the vehicle (e.g., near the front) by an arrangement of cables. The handle and cables are arranged such that horizontal pivoting of the handle results in a corresponding horizontal pivot of the firefighting monitor, and vertical pivoting of the handle results in a corresponding vertical pivot of the firefighting monitor. The direct mechanical link between the handle and firefighting monitor ensures a rapid and reliable control over the monitor direction and orientation, while providing an intuitive and user friendly operational modality.

In one form thereof, the present disclosure provides a system for remotely directing a flow of firefighting fluid, the system comprising: a firefighting monitor having a fluid inlet and a fluid outlet, the fluid outlet pivotable along a side-to-side monitor sweep and an up-and-down monitor sweep; and a control mechanism spaced from the firefighting monitor, the control mechanism pivotable along a side-to-side control sweep and an up-and-down control sweep; an arrangement of cables mechanically connected to the firefighting monitor and the control mechanism, such that movement of the control mechanism along the side-to-side control sweep causes corresponding movement of the firefighting monitor along the side-to-side monitor sweep, and such that movement of the control mechanism along the up-and-down control sweep causes corresponding movement of the firefighting monitor along the up-and-down monitor sweep.

In another form thereof, the present disclosure provides a control mechanism for directing a flow of firefighting fluid, the mechanism comprising: a base structure; a turntable rotatably mounted to the base structure about a vertical axis, the turntable having a pair of side-to-side adjustment cables affixed to opposing sides of a radial wall of the turntable, such that rotation of the turntable selectively tensions one of the pair of side-to-side adjustment cables; a barrel rotatably mounted to the turntable about a horizontal axis, the barrel having a pair of up-and-down adjustment cables affixed to opposing sides of a radial wall of the barrel, such that rotation of the barrel selectively tensions one of the pair of up-and-down adjustment cables; and a handle affixed to the barrel, such that the handle is moveable along a side-to-side direction to rotate the turntable, and the handle is moveable along an up-and-down direction to rotate the barrel.

In yet another form thereof, the present disclosure provides a method of manually adjusting the position and orientation of a firefighting monitor from a remote operator station, the method comprising: moving a handle of a proximal control mechanism in one of a left handle direction, a right handle direction, an up handle direction and a down handle direction; and tensioning a cable by the step of moving the handle, the cable extending from the remote operator station to the firefighting monitor such that the tension imparted to the firefighting monitor to move the firefighting monitor in one of: i) a left monitor direction where the handle is moved in the left handle direction; ii) a right monitor direction where the handle is moved in the right handle direction; iii) an up monitor direction where the handle is moved in the up handle direction; and iv) a down monitor direction where the handle is moved in the down handle direction.

BRIEF DESCRIPTION OF THE DRAWINGS

The above-mentioned and other features and advantages of the present disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one exemplary embodiment of the invention, and such exemplification is not to be construed as limiting the scope of the invention in any manner.

DETAILED DESCRIPTION

The embodiments disclosed herein are not intended to be exhaustive or to limit the invention to the precise form disclosed in the following detailed description. Rather, the embodiments are chosen and described so that others skilled in the art may utilize their teachings. While the present disclosure is directed to the delivery of a firefighting fluid delivery system adapted to combat fires, it will be understood that the system may have applications to other scenarios. For example, in one alternative implementation, the systems and methods disclosed herein may be utilized to provide a fluid for neutralizing or altering one or more chemical substances, such as chemicals used in explosives, drugs or other items. In another alternative implementation, the systems and methods disclosed herein may be used in a law enforcement context, such as for riot control and/or immobilization of individuals. Moreover, while the exemplary embodiment described below provides a remote actuation system for mechanically manipulating a firefighting monitor, it is contemplated that the remote mechanical actuation system may be applied in other contexts, to remotely direct the discharge of material from an aimable output device.

Figure 1:
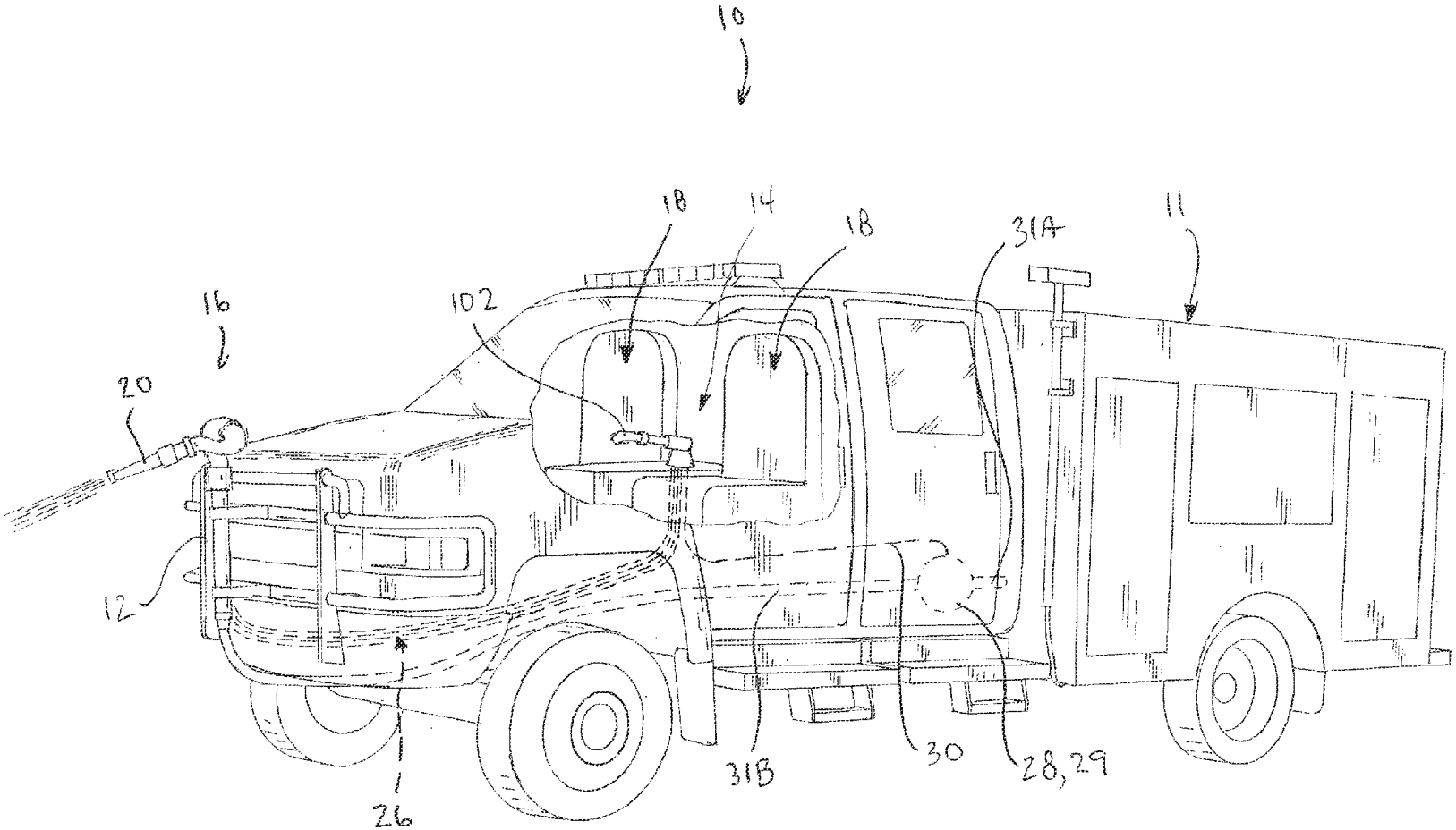
FIG. 1 is a perspective view of a fire engine having a remotely mechanically controlled firefighting monitor made in accordance with the present disclosure.

As used herein, "proximal" refers to a direction generally toward the operator of the presently described remote actuation system, and "distal" refers to the opposite direction of proximal, i.e., away from the operator. Thus, as shown in FIG. 1 and described in further detail below, the proximal portion of the illustrated remote actuation system is proximal control mechanism 14 located within the operator's cabin of fire engine 10 and adjacent operator stations 18, while the distal portion of such remote actuation system is distal control mechanism 16 disposed outside the operator's cabin, e.g. mounted on front bumper 12, and is therefore spaced away and inaccessible from either of operator stations 18.

As used herein, "firefighting monitor" refers to a fluid discharge device adapted for use in fighting structure fires, wildland fires, or other fires large enough to warrant the implementation of professional firefighting equipment. For example, monitor 20 shown in FIG. 1 may have a throughput on the order of dozens to hundreds of US gallons/minute at a standard operating pressure of 100-200 psi of fluid pressure. In some instances, this throughput may be between about 60 gallons/minute and about 200 gallons/minute, which are typical fluid flow rates for handheld or vehicle-mounted firefighting monitors. However, it is contemplated that greater flow rates could be employed by increasing the leverage provided by proximal and distal control mechanisms 14, 16, such as by increasing the distance between handle 102 and barrel 104 and sizing pulleys 64 and cables 54A, 54B, 74A, 74B accordingly.

As used herein, "Bowden cables" refer to actuation cables which include a cable sheath or housing disposed over a cable core, in which the cable core is longitudinally moveable with respect to the housing. For example, an exemplary Bowden cable may include a cable core (e.g., cable core 22 shown in FIG. 4) made of a material adapted to transmit mechanical force or energy, e.g., steel or stainless steel, contained within a hollow outer cable housing (e.g., housing 24 shown in FIG. 4). In some cases, a Bowden cable may further include a lubricious intermediate layer disposed between the inner cable core and cable housing to facilitate longitudinal movement therebetween. The housing may be a spirally wound metal layer, which forms a bendable, protective outer tube. The housing may also include a protective outer coating made of a corrosion-resistant material such as plastic.

The actuation cables illustrated in the drawings and described in further detail below show only core 22 and housing 24, it being understood that no further structures are required for operative function of the illustrated Bowden cable. However, it is appreciated that additional structures such as a nylon sheath for lubricity and/or a plastic coating over the housing 24 may be provided as required or desired for a particular application. In one exemplary embodiment, a Bowden cable suitable for use in the firefighting structure shown may be a wire rope having seven 19-strand cables (i.e., 7×19) wound into cable core 22, with cable housing 24 formed of a nylon sleeve over the 7×19 core. In a particular exemplary embodiment, this Bowden cable may have an overall diameter of 0.062 inches including the 7×19 cable core with an outer diameter of 0.048 inches. Alternatively, a higher-strength option may be provided in which cable housing 24 is eliminated (i.e., cable core 22 is uncoated), such that the 7×19 cable core consumes the entire 0.062 outside diameter. In this alternative, provisions must be made for routing such a cable between proximal and distal control mechanisms 14, 16, or a housing must be provided for routing in accordance with the illustrated embodiment.

Turning now to FIG. 1, a mechanical remote actuation system made in accordance with the present disclosure is shown in the context of fire engine 10. In the illustrated application, the remote actuation system is used to mechanically control the direction and orientation of fluid flow from monitor 20, which is mounted to bumper 12 and may or may not be viewable from either the driver's or passenger's operator station 18 within in the vehicle cabin. Such mechanical control is effected by manually exerting a force upon handle 102, which is disposed between operator stations 18 such that a firefighter sitting in either front seat of the cabin can exert such manual forces. These manual forces are directly and mechanically transmitted to monitor 20, which then mimics the movement and orientation of handle 102. This control modality is intuitive and easy to learn. Although operator stations 18 are shown within the cabin of fire engine 10, and are illustrated as the passenger and driver's seats, it is appreciated that operator station 18 may be located at any position remote from monitor 20 as required or desired for a particular application.

Moreover, the remote actuation system of the present disclosure may be used where the distal output point is inaccessible from the operator's station. In some instances this may be because the distal output is spaced substantially away from the proximal input mechanism, such as by about 6 feet or more, while in other cases the distal output may be within arm's reach but blocked by a barrier (such as a windshield or door). For purposes of the present disclosure, "remote operation" is any operation in which manual manipulation of proximal control mechanism 14 results in movement of distal control mechanism 16 that cannot be manually effected when the operator is positioned at operator station 18. For example, any arrangement of the remote actuation system in which monitor 20 is beyond the wingspan of the operator when the operator is positioned at operator station 18 would be considered a remote operation. Similarly, monitor 20 may be separated from operator station 18 by a barrier which precludes manual manipulation of monitor 20 by the operator, such that "remote operation" of monitor 20 might occur even when monitor 20 is within the wingspan of the operator at operator station 18.

Referring still to FIG. 1, proximal and distal control mechanisms 14, 16 are mechanically linked to one another by cabling arrangement 26. As described in detail below, cabling arrangement 26 includes a set of four cables (54A, 54B, 74A, 74B in FIG. 7) having respective essentially inelastic cable cores 22, each of which can be selectively tensioned by force applied at proximal control mechanism 14 to transmit such force to distal control mechanism 16 and monitor 20. Two of the four cables of cabling arrangement 26 (i.e., cables 54A, 54B) are configured to transmit left and right side-to-side movements of proximal control mechanism 14 to distal control mechanism 16, while the other two cables (i.e., cables 74A, 74B) of cabling arrangement 26 are configured to transmit up-and-down movement from proximal control mechanism 14 to distal control mechanism 16. Each of the cables of cable arrangement 26 (i.e., cables 54A, 54B, 74A and 74B) may be provided in a length sufficient to place proximal and distal control mechanisms 14, 16 as far apart from one another as needed, such as at least 6 feet apart. As further described below, side-to-side adjustment cables 54A, 54B are actuatable independently of up-and-down adjustment cables 74A, 74B, and vice-versa. This independent actuation allows the user of proximal control mechanism to selectively sweep monitor 20 through side-to-side or up-and-down movements by a corresponding movement of handle 102. In addition, such side-to-side and up-and-down movements may occur simultaneously, so that monitor 20 can be drawn along any desired diagonal movement profile.

Fire engine 10 illustrated in FIG. 1 includes control 28, which may have various control apparatuses operably connected to various functions of fire engine 10, such as charging of water pressure within hoses routed to monitor 20 or other fire hoses, for example. In the illustrated embodiment, engine 10 may have a water reservoir aboard with a quantity of firefighting fluid (such as water) sufficient to extinguish a fire at a site remote from a continuous water supply. For example, a fluid tank 11 may be provided with a fluid capacity of as little as 100 gallons, or as much as 500 gallons or more than 1000 gallons. Fluid tank 11 is isolated from the fuel tank of engine 10, and contains non-flammable firefighting fluid.

As illustrated, proximal control mechanism 14 is operably connected to control 28 via connection line 30. Fluid flow through monitor 20 may be selectively allowed or prevented by the operator of proximal control mechanism 14 by selectively activating the relevant portion of control 28 via connection line 30, as further described below. When such activation occurs, pump 29 pumps fluid from fluid tank 11 to monitor 20 via fluid lines 31A, 31B.

Figure 2:
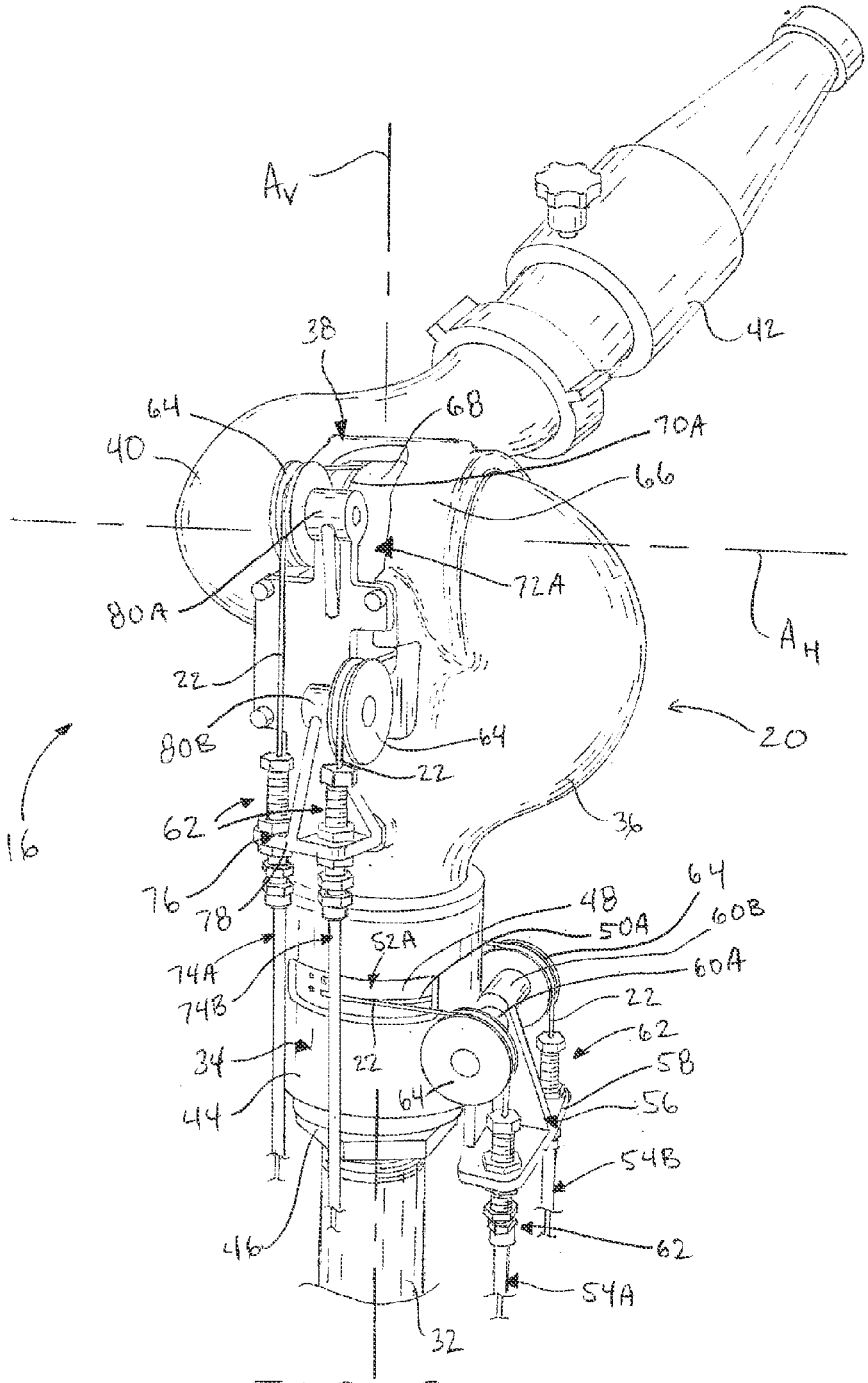
FIG. 2 is a perspective view of the system shown in FIG. 1, illustrating a distal control mechanism of the remote actuation system.

Turning now to FIG. 2, distal control mechanism 16 and monitor 20 are shown in greater detail. Inlet conduit 32 delivers fluid to firefighting monitor 20, which routes the firefighting fluid through first pivot coupling 34 and around first elbow 36, then to second pivot coupling 38 and around second elbow 40. Fluid is discharged from monitor 20 via nozzle 42, which may be any suitable nozzle device depending on the particular application and firefighting fluid used. As described in further detail below, first pivot coupling 34 facilitates rotation of the components downstream (i.e., elbows 36, 40, second pivot coupling 38, and nozzle 42) about vertical axis $A_V$, thereby enabling horizontal adjustment of nozzle 42 and its associated fluid stream away from a "forward" or centered orientation. Similarly, second pivot coupling 38 allows the components downstream thereof (i.e., elbow 40 and nozzle 42) to pivot or rotate about horizontal axis $A_H$, thereby facilitating an up-and-down adjustment of nozzle 42 and the associated fluid stream away from the "forward" or centered orientation. For purposes of the present disclosure, a centered orientation of monitor 20 is one in which monitor 20 may move through approximately equal angular sweeps either left and right, or up and down. A "forward" orientation is an orientation along a particular desired direction, such as toward the front of fire engine 10. Handle 102, which is a longitudinal structure defining a longitudinal axis, similarly defines centered and forward orientations in the same manner.

Figure 10:
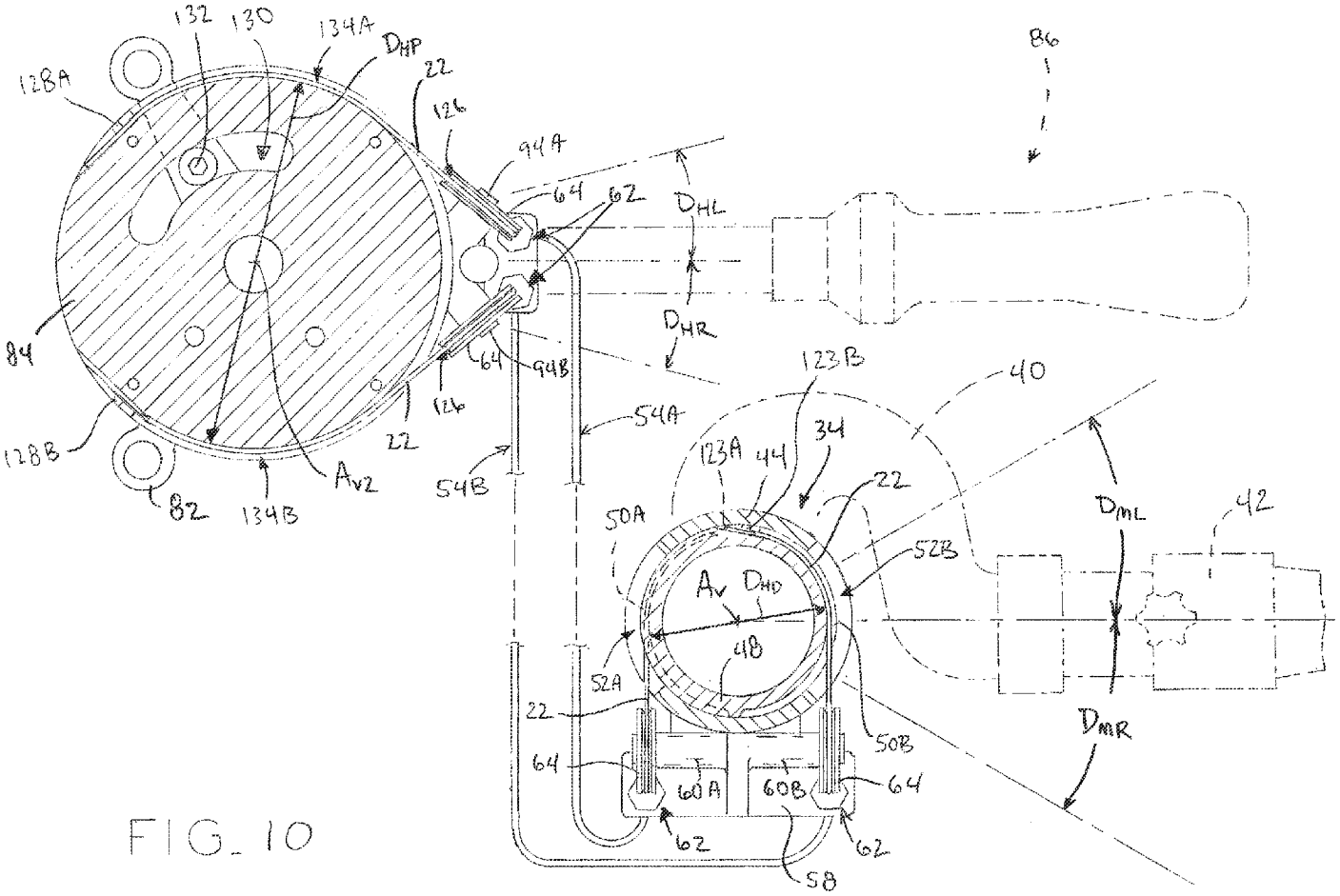
FIG. 10 is a plan, schematic, cross-sectional view of the remote actuation system shown in FIG. 9.

Referring to FIGS. 2 and 10, first pivot coupling 34 includes outer sleeve 44, which is fixed to inlet conduit 32 (FIG. 2) via a female threaded hex nut portion 46. Inner sleeve 48 of first pivot coupling 34 is received within outer sleeve 44, and includes a pair of grooves 50A, 50B (FIG. 10) machined in an outer surface thereof. Grooves 50A, 50B align with corresponding apertures 52A, 52B (FIG. 10) formed in outer sleeve 44 when inner sleeve 48 is pivotably received within outer sleeve 44 as shown in FIG. 2. As described in further detail below, respective cable cores 22 of side-to-side adjustment cables 54A, 54B pass through apertures 52A, 52B and into grooves 50A, 50B. Terminal ends of respective cable cores 22 of side-to-side adjustment cables 54A, 54B affix to inner sleeve 48 at attachment points 123A, 123B (FIG. 10), such as by set screws extending transversely into the outer wall of inner sleeve 48 via grooves 50A, 50B, toward vertical axis $A_V$ as illustrated. Actuation of side-to-side adjustment cables 54A, 54B causes tension in one of the essentially inelastic cable cores 22 thereof, which in turn causes rotation of inner sleeve 48 with respect to outer sleeve 44 about vertical axis $A_V$. As inner sleeve 48 rotates, nozzle 42 sweeps through left or right side-to-side movements, i.e., movements along directions $D_{ML}$, $D_{MR}$. When the potential magnitude of $D_{ML}$ and $D_{MR}$ are the same, nozzle 42 is considered to be horizontally centered. In an exemplary embodiment, nozzle 42 is installed on engine 10 such that the outlet of the outlet of nozzle 42 is centered when such outlet is pointing forward, i.e., along a back-to-front direction of engine 10.

Outer sleeve 44 includes cable mounting bracket 56 affixed thereto, although it is also contemplated that bracket 56 may be integrally formed as a single monolithic part together with outer sleeve 44 (e.g., by integrating bracket 56 into the mold for casting outer sleeve 44). Bracket 56 includes base portion 58, through which terminal cable mounting assemblies 62 are received and supported. Bracket 56 further includes axle portions 60A, 60B positioned to rotatably receive pulleys 64 as further described below. A cover (not shown) may be affixed to outer sleeve 44 over bracket 56 to protect pulleys 64, the associated cable cores 22, and other moving parts from ambient fluids or other contaminants.

In an exemplary embodiment, grooves 50A and 50B are swept through an arcuate path having a radius or multiple radii perpendicular to vertical axis $A_V$, and have overlapping arcuate sweeps as illustrated in FIG. 10. To facilitate this overlapping geometry, grooves 50A and 50B are positioned at differing vertical positions along vertical axis $A_V$, and axle portions 60A, 60B are also vertically offset in similar fashion as best seen in FIG. 2.

Referring still to FIG. 2, first elbow 36 extends downstream/distally from first pivot coupling 34, and is fixed to inner sleeve 48 such that rotation of inner sleeve 48 also rotates elbow 36. In one exemplary embodiment, inner sleeve 48 and elbow 36 are monolithically formed as a single part. As illustrated, the fluid pathway of elbow 36 redirects fluid flowing therethrough such that fluid exiting elbow 36 and entering second pivot coupling 38 is traveling along horizontal axis $A_H$ and perpendicularly to axis $A_V$. The output end of first elbow 36 is fixed to outer sleeve 66 of second pivot coupling 38, and may also be monolithically formed therewith.

Figures 5A, 6:
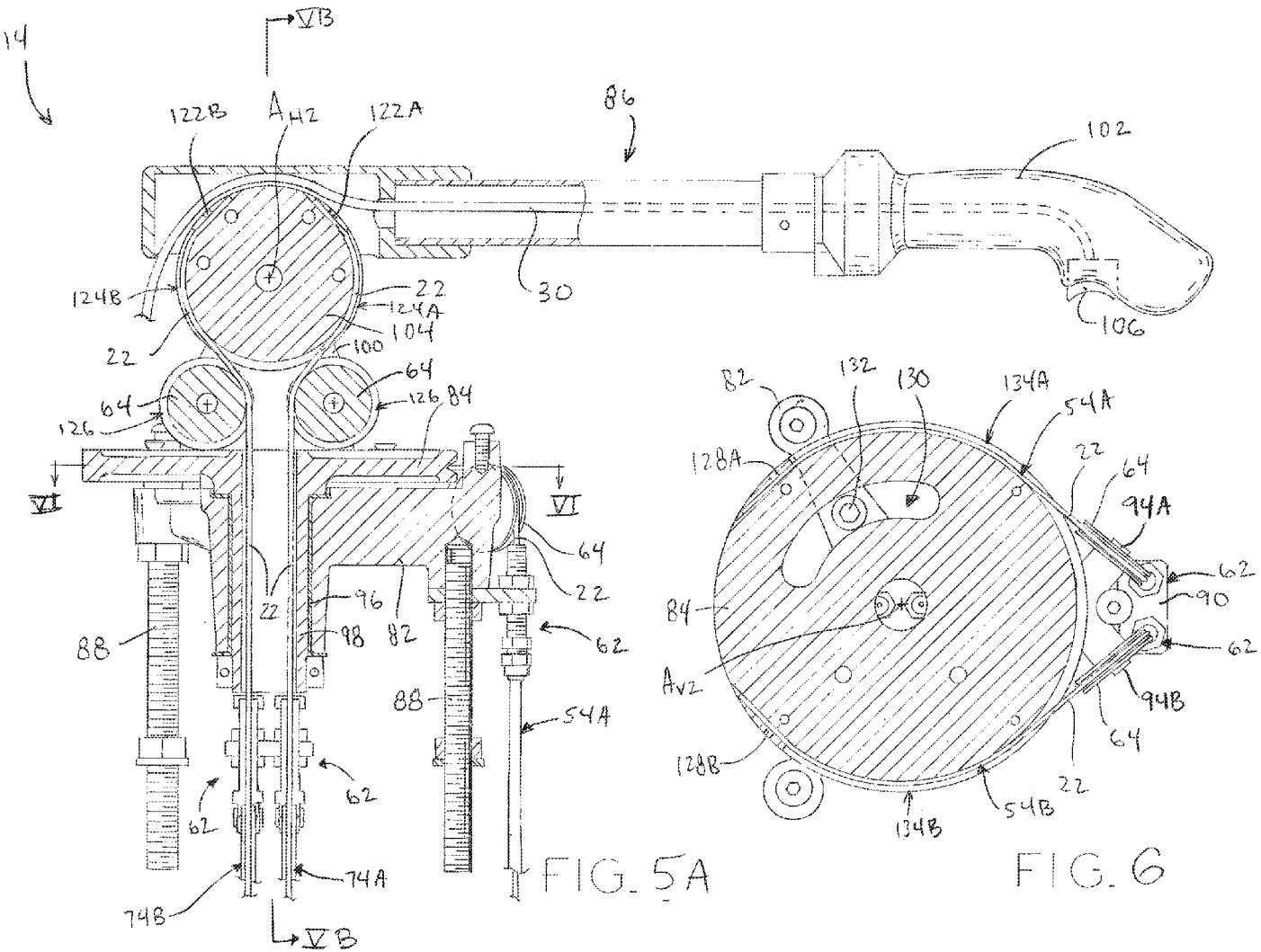
FIG. 5A is a side elevation, cross-section view of the proximal control mechanism shown in FIGS. 3A and 3B.
FIG. 6 is a plan, cross-section view of a portion of the proximal control mechanism shown in FIGS. 5A and 5B, taken along line VI-VI of FIG. 5A.

Similarly to first pivot coupling 34, second pivot coupling 38 also includes inner sleeve 68 having grooves 70A, 70B (FIG. 8) formed in the outer surface thereof and mutually opposed to one another. Grooves 70A, 70B are sized to receive the terminal ends of cable core 22 of up-and-down adjustment cables 74A, 74B respectively, which are affixed to inner sleeve 68 at attachment points 128A, 128B (FIG. 6). Actuation of cables 74A, 74B causes inner sleeve 68 to rotate with respect to outer sleeve 66, thereby effecting an up-and-down sweep of monitor 20. Cable mounting bracket 76 is fixed to first elbow 36 and outer sleeve 66, and contains base portion 78 with terminal cable mounting assemblies 62 mounted thereto as illustrated. Mounting bracket 76 further includes axle portions 80A, 80B which rotatably support pulleys 64 as described further below. Similar to bracket 56 described above, it is contemplated that bracket 76 may be integrally formed as a single monolithic part together with outer sleeve 66 (e.g., by integrating bracket 76 into the mold for casting outer sleeve 66). A cover (not shown) may also be provided to protect the associated pulleys 64, cable cores 22 and other structures adjacent to bracket 76 from firefighting fluid or other ambient contaminants.

Downstream of second pivot coupling 38, second elbow 40 curves the stream path as illustrated such that the direction of outward flow from nozzle 42 is substantially perpendicular to the direction of flow through second pivot coupling 38. In this arrangement, first pivot coupling 34 is formed from a male portion of elbow 36 (i.e., inner sleeve 48), which is received within the female receiving portion formed by outer sleeve 44. To facilitate rotation therebetween, a bearing (e.g. a ball bearing assembly) may be interposed between inner sleeve 48 and outer sleeve 44. A fluid seal (e.g., an O-ring) may also be interposed between inner sleeve 48 and outer sleeve 44 to prevent fluid leakage at pivot coupling 34. Similarly, second pivot coupling 34 is formed from a male portion of elbow 40 (i.e., inner sleeve 68), which is received within the female receiving portion of elbow 36 (i.e., outer sleeve 66). Second pivot coupling 38 may include a bearing and fluid seal arranged similar to first pivot coupling 38.

In an exemplary embodiment, the geometry and arrangement of first and second pivot couplings 34, 38 and first and second elbows 36, 40 may utilize the arrangements shown and described in U.S. Design Pat. No. D479,314 filed Aug. 23, 2002 and entitled FIRE FIGHTING MONITOR, U.S. Pat. No. 7,243,864 filed Nov. 11, 2005 and entitled RADIO CONTROLLED LIQUID MONITOR, or U.S. Patent Application Publication No. 2010/0274397, filed Apr. 21, 2010 and entitled FIREFIGHTING MONITOR AND CONTROL SYSTEM THEREFOR, the entire disclosures of which are hereby expressly incorporated by reference herein. Another exemplary overall size and geometry for monitor 20 can be found in the "Sidewinder" monitor available from Elkhart Brass Manufacturing Company, Inc. of Elkhart, Ind., USA.

Figure 3A:
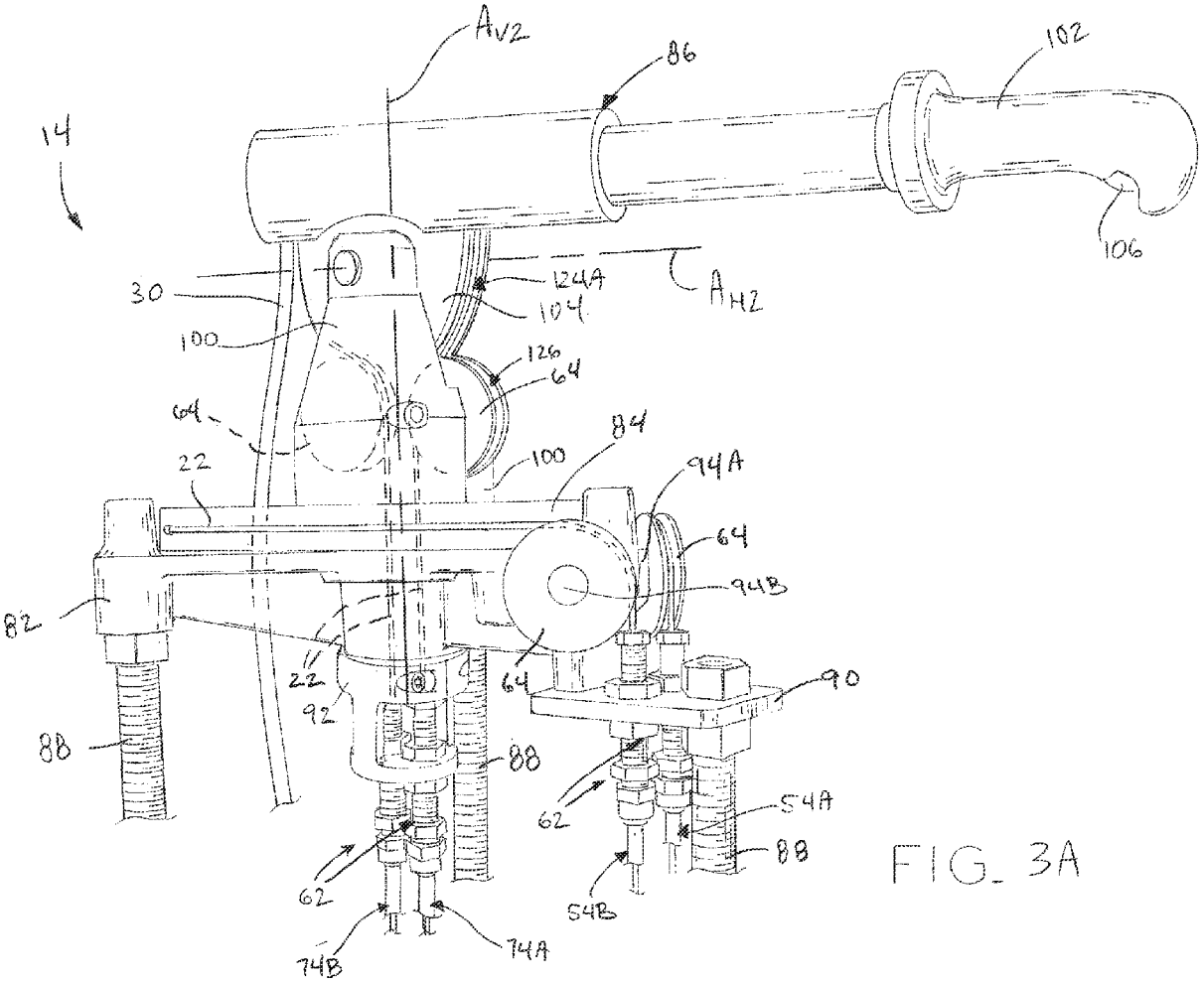
FIG. 3A is a perspective view of the system shown in FIG. 1, illustrating a proximal control mechanism of the remote actuation system.
Figure 3B:
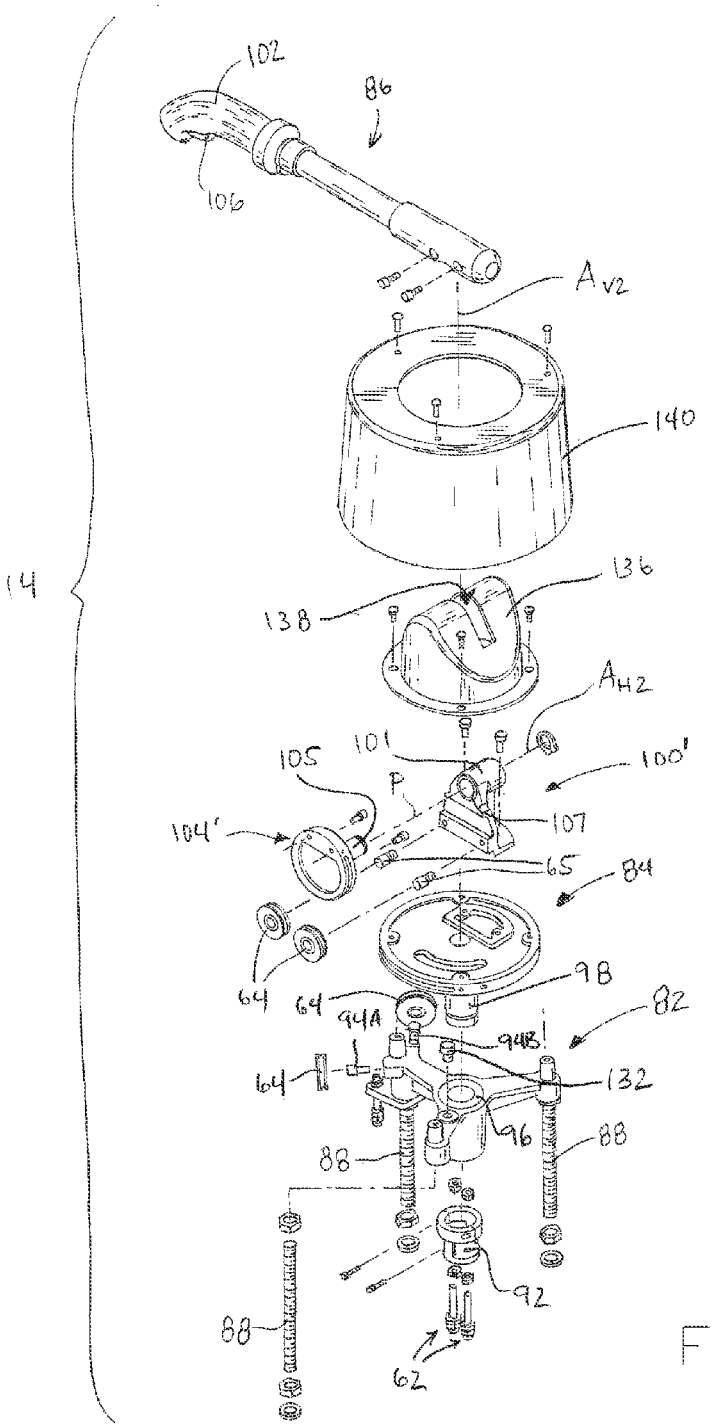
FIG. 3B is a perspective, exploded view of an alternative proximal control mechanism in accordance with the present disclosure.

Turning now to FIGS. 3A and 3B, proximal control mechanism 14 includes a base structure 82, a turntable 84 rotatably mounted to base structure 82 about vertical axis $A_{V2}$, and control handle assembly 86 pivotably mounted to turntable 84 about horizontal axis $A_{H2}$. As described in detail below, side-to-side adjustment cables 54A, 54B and up-and-down adjustment cables 74A, 74B (which collectively form cable arrangement 26, shown in FIG. 1) are routed from distal control mechanism 16 (FIG. 2) to proximal control mechanism 14, where actuation of cables 54A, 54B, 74A, 74B is selectively performed by an operator through manual manipulation of control handle assembly 86.

Base structure 82 forms the fixed mounting point for the other structures of proximal control mechanism 14, and is considered a fixed component in the context of the other, moveable components of the remote actuation system described herein. In the exemplary embodiment shown in FIGS. 3A and 3B, base structure 82 is attached to a plurality of threaded studs 88 which may extend from the support surface chosen for proximal control mechanism 14. For example, in the illustrated embodiment of FIG. 1, studs 88 may extend vertically from the floor of the cabin of fire engine 10 adjacent operator stations 18. Affixed to a lower portion of base structure 82 are wire mounting flange 90 and wire mounting collar 92, each of which provides structural support for terminal cable mounting assemblies 62 for each of the proximal ends of cables 54A, 54B, 74A, 74B. As illustrated, wire mounting flange 90 is fixed relative to the other components of the remote actuation system, but wire mounting collar 92 is rotatably mounted to base structure 82 such that rotation of turntable 84 (described in detail below) concomitantly rotates wire mounting collar 92 and thereby avoids undue twisting of cable cores 22 extending therebetween. Base structure 82 further includes axle portions 94A, 94B (FIG. 6) to which pulleys 64 are rotatably mounted for routing of respective cable cores 22 as described further below.

Figure 5B:
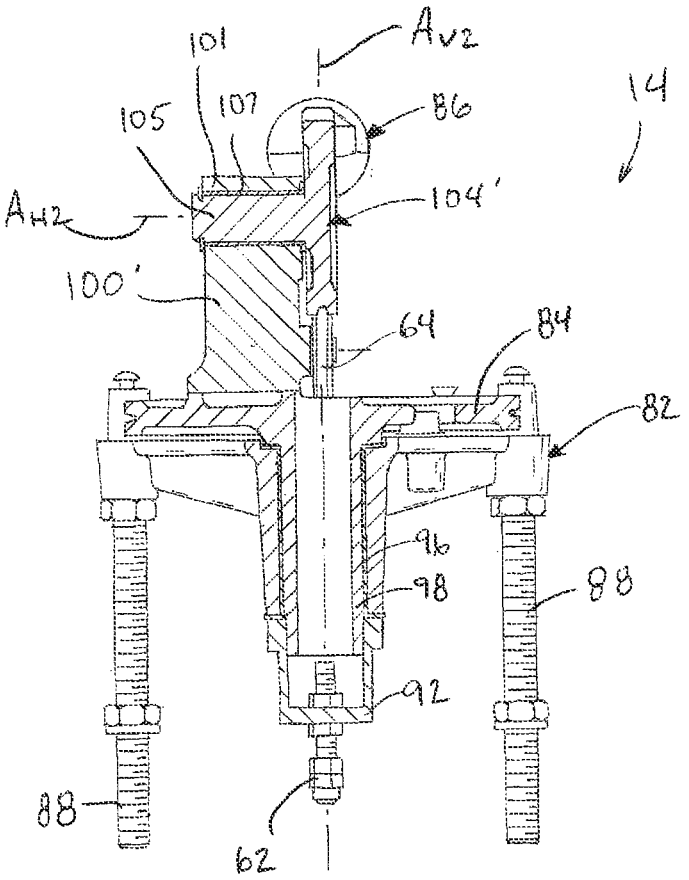
FIG. 5B is a front elevation, cross-section view of the proximal control mechanism shown in FIGS. 3A and 3B.

Turning now to FIGS. 5A and 5B, turntable 84 is rotatably mounted to base structure 82 as illustrated. In the exemplary illustrated embodiment, low friction sleeve 96 may be disposed between the downwardly extending stem 98 of turntable 84 and the adjacent bore formed in base structure 82. Sleeve 96, which may be made of nylon, graphite or another low friction material, provides a durable and long lasting low-friction interface between turntable 84 and base structure 82 to facilitate rotation of turntable 84.

While turntable 84 is the primary supporting structure for driving side-to-side adjustment of monitor 20, the up-and-down adjustment components of proximal control mechanism 14 are structurally supported by support 100 as shown in FIG. 3A. Support 100, illustrated as mounting bracket 100 in FIG. 3A, extends upwardly from turntable 84 and is fixed to turntable 84 (e.g., by mechanical fixation or by integrally and monolithically forming mounting bracket 100 with turntable 84). Thus, the up-and-down adjustment components (including handle assembly 86, barrel 104 and its associated pulleys 64 and mounting bracket 100) are carried by turntable 84, such that a side-to-side adjustment of proximal control mechanism 14 (e.g., by swinging handle 102 left or right) also rotates the up-and-down adjustment components about vertical axis $A_{V2}$. However, such rotation of the up-and-down adjustment components does not cause any corresponding tensioning of up-and-down adjustment cables 74A, 74B, thereby preserving the independent side-to-side and up-and-down adjustments to the orientation of monitor 20 afforded by proximal control mechanism 14 as noted above. In order to accommodate side-to-side rotation of handle 102 without introducing tension in up-and-down adjustment cables 74A, 74B, the up-and-down adjustment components are arranged symmetrically around vertical axis $A_{V2}$. More specifically, FIG. 3A illustrates that the pivot axis for barrel 104, i.e., horizontal axis $A_{H2}$, is arranged upon vertical axis $A_{V2}$ such that vertical and horizontal axes $A_{V2}$, $A_{H2}$ cross one another (i.e., intersect). In addition, pulleys 64 route proximal ends 22 of up-and-down adjustment cables 74A, 74B along a vertical path between respective cable mounting assemblies 62 and grooves 124A, 124B of barrel 104 (FIG. 5A), such that each such vertical cable path is parallel to vertical axis $A_{V2}$. These vertical cable paths are equally spaced from vertical axis $A_{V2}$, and are positioned close to axis $A_{V2}$, such as within less than one inch away. In one exemplary embodiment, this distance is about ⅜ inch.

As the up-and-down adjustment components rotate together with turntable 84 during side-to-side movement of handle 102, concomitant rotation of collar 92, cable mounting assemblies 62, and proximal ends 22 cause a slight "twisting" of up-and-down adjustment cables 74A, 74B below collar 92. However, adjustment cables 74A, 74B have a relatively long span between collar 92 and distal control mechanism 16, such as at least one foot and in some embodiments up to several feet or even several dozen feet, so that this "twisting" is distributed over the long span and does not materially contribute to any stretching of cable cores 22. To the extent that minimal stretching may occur, the above-described vertical pathways of proximal ends 22 of up-and-down adjustment cables 74A, 74B cooperate with the symmetrical arrangement thereof around vertical axis $A_{V2}$ to ensure that any increased tension experienced within cable cores 22 as a result of such twisting is shared equally within up adjustment cable 74A and down adjustment cable 74B. This equalized increase in tension, in turn, ensures that no up or down movement of monitor 20 will occur as a result of side-to-side movement of handle 102. In addition to the relatively long span of up-and-down adjustment cables 74A, 74B, the increased tension experienced by cable cores 22 during side-to-side movements is also kept to a minimum by the minimal radial spacing between up-and-down adjustment cables 74A, 74B and vertical axis $A_{V2}$.

In an alternative configuration shown in FIGS. 3B and 5B, mounting stanchion 100' and barrel 104' may be provided to support handle assembly 86. The overall operation of proximal control mechanism 14 is the same regardless of whether stanchion 100' is used with barrel 104', or mounting bracket 100 is used with barrel 104. For purposes of the present disclosure, references to "support 100" and "barrel 104" refer interchangeably to brackets or stanchion 100, 100' and barrels 104, 104' respectively unless otherwise noted. However, stanchion 100' provides mounting tube 101, which rotatably receives mounting stem 105 of barrel 104' from along assembly path P such that barrel 104' mounts to stanchion 100' from one side only, thereby simplifying assembly and maintenance. A low-friction sleeve 107 (FIG. 5B) may be provided between mounting stem 105 and the bore of mounting tube 101 to facilitate rotation therebetween upon up-and-down movement of handle assembly 86. Pulleys 64 also mount to axles 65 by assembly to the side of stanchion 100' as illustrated in FIG. 3B.

FIG. 3B also illustrates stanchion cover 136, which is sized to cover the assembly of stanchion 100', barrel 104' and the associated pair of pulleys 64. Handle assembly 86 can then be received within slot 138 of cover 136 to attach to barrel 104'. Turntable cover 140 may also be provided to cover turntable 84, base structure 82 and the associated pulleys 64.

FIG. 6 illustrates arcuate slot 130 formed in turntable 84, into which boss 132 passes. Boss 132 is affixed to a portion of base structure 82, as illustrated, such that the total rotational limits of turntable 84 are limited by interaction between slot 130 and boss 132. More particularly, boss 132 physically prevents further rotation of turntable 84 when boss 132 comes into contact with either end of arcuate slot 130. In the exemplary embodiment illustrated, side-to-side rotation of turntable 84 is limited to about 90 degrees by arcuate slot 130. This limit allows a user to fully rotate turntable 84 through its range of motion without exceeding the normal range of motion of the user's arm. As described below, this limit corresponds to a total potential side-to-side sweep of monitor 20 double that of turntable 84, i.e., about 180 degrees.

Turning again to FIGS. 3A and 3B, control handle assembly 86 includes control handle 102 fixed to barrel 104. Barrel 104, in turn, is affixed to a pair of cable cores 22 of up-and-down adjustment cables 74A, 74B, as best seen in FIG. 5A and described further below. In addition, control handle assembly 86 may include trigger 106 in control handle 102, which is mechanically or electrically connected via connection line 30 to control 28, which in turn actuates a valve operable to selectively allow or prevent the flow of firefighting fluid from monitor 20 (FIG. 1). As illustrated in FIG. 5A and described in further detail below, a pair of pulleys 64 are rotatably connected to support 100 (FIGS. 3A and 3B) and operably disposed between barrel 104 and turntable 84, so as to aid in efficient routing of cable cores 22 of up-and-down adjustment cables 74A, 74B from barrel 104 to cable mounting assemblies 62.

As noted above and shown in FIG. 4, each of the various control cables 54A, 54B, 74A, 74B interface with proximal and distal control mechanisms 14, 16 via terminal cable mounting assembly 62. More particularly, cable mounting assembly 62 facilitates the transition from an exposed cable core 22, which is suitable for coupling to the various structures of proximal and distal control mechanisms 14, 16 and transmitting force therebetween, and the full Bowden cable arrangement including cable core 22 and the protective, low friction cable housing 24 which surrounds core 22 throughout most of the routing distance between proximal and distal control mechanisms 14, 16.

Figure 4:
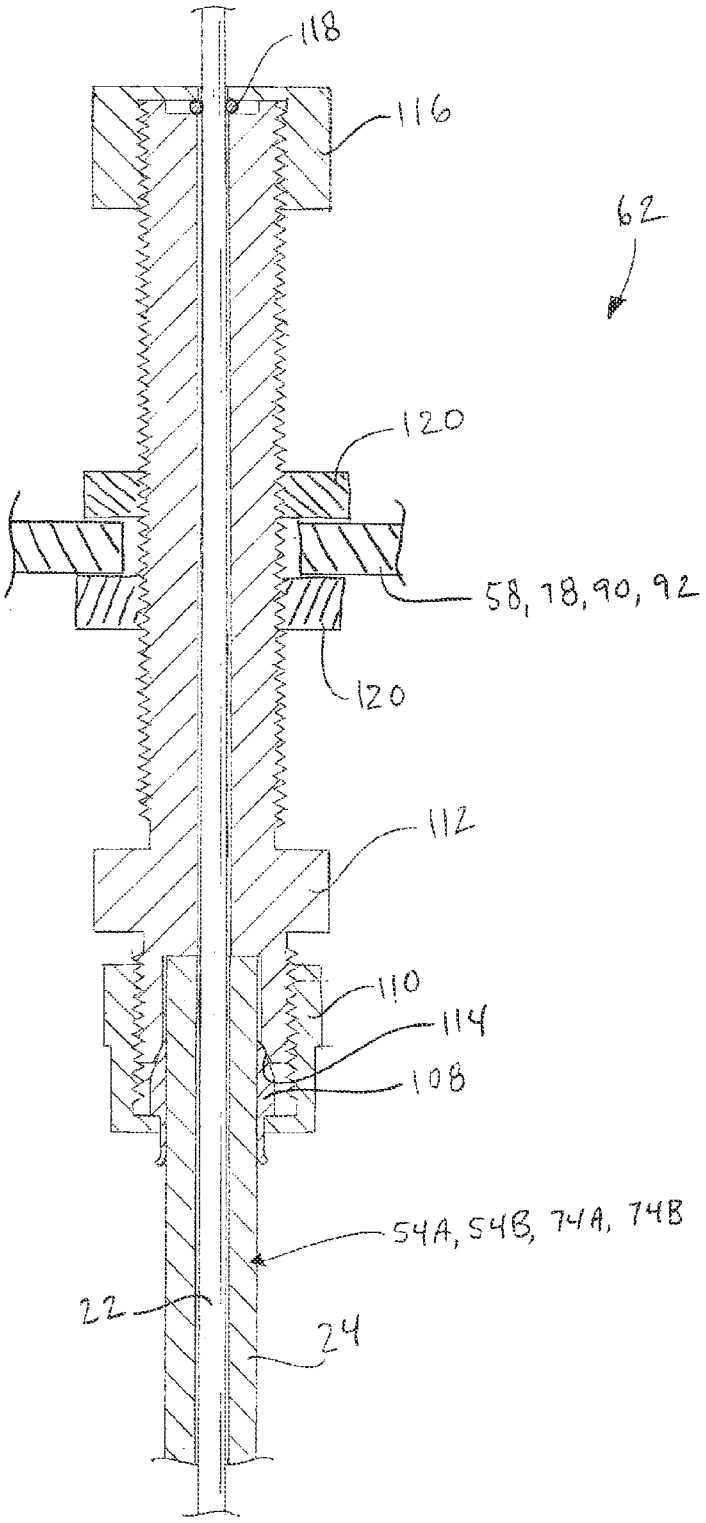
FIG. 4 is an elevation, cross-section view of a terminal cable mounting assembly used in conjunction with distal and proximal control mechanisms in accordance with the present disclosure.

Referring still to FIG. 4, an elevation, cross-sectional view of cable mounting assembly 62 illustrates structures used to make this transition. As illustrated, a terminal end of any of cables 54A, 54B, 74A, 74B may engage an axial input end of cable mounting assembly 62, with the respective cable core 22 emerging from the opposing axial output end. At the input end, cable core 22 and cable housing 24 pass through ferrule 108, which in turn is received within input end cap nut 110 as shown. Cap nut 110 is threadably received upon main body 112 of cable mounting assembly 62, such that as cap nut 110 is tightened, ferrule 108 is urged into contact with main body 112 at ramped interface 114, which in turn compresses ferrule 108 into firm and liquid-tight contact with the adjacent outer surface of cable housing 24. In this way, any fluid present in the vicinity of the input end of cable mounting assembly 62 will be precluded from gaining entry to the space between cable core 22 and cable housing 24, thereby preventing contamination of the lubricious interface therebetween. At the output end of cable mounting assembly 62, cap nut 116 is provided to seal fluids from ingress at the output end. As illustrated, cap nut 116 is threadably received on main body 112, and O-ring 118 is captured between main body 112 and cap nut 116. O-ring 118 is sized to sealingly engage the outer surface of cable core 22, such that any moisture which may exist in the vicinity of the output end of cable mounting assembly 62 is precluded from gaining entry therein. In addition, any contamination which may be present on the outer surface of cable core 22 will be prevented from passing into the bore of main body 112 by O-ring 118. The above-described input-end and output-end sealing arrangements completely seal the inner bore of cable mounting assembly 62, protecting the point at which cable core 22 emerges from cable housing 24.

Terminal cable mounting assembly 62 also provides for cable tension adjustment. As noted above and represented schematically in FIG. 4, cable mounting assembly 62 attaches to various structures of proximal control mechanism 14 or distal control mechanism 16, such as base portion 58 of cable mounting bracket 56 (FIG. 2), base portion 78 of cable mounting bracket 76 (FIG. 2), wire mounting flange 90 of base structure 82 (FIGS. 3A and 3B), or wire mounting collar 92 disposed below base structure 82 (FIGS. 3A and 3B). Main body 112 of cable mounting assembly 62 is axially fixed to such mounting structures by upper and lower threaded nuts 120 as shown in FIG. 4.

Figure 8:
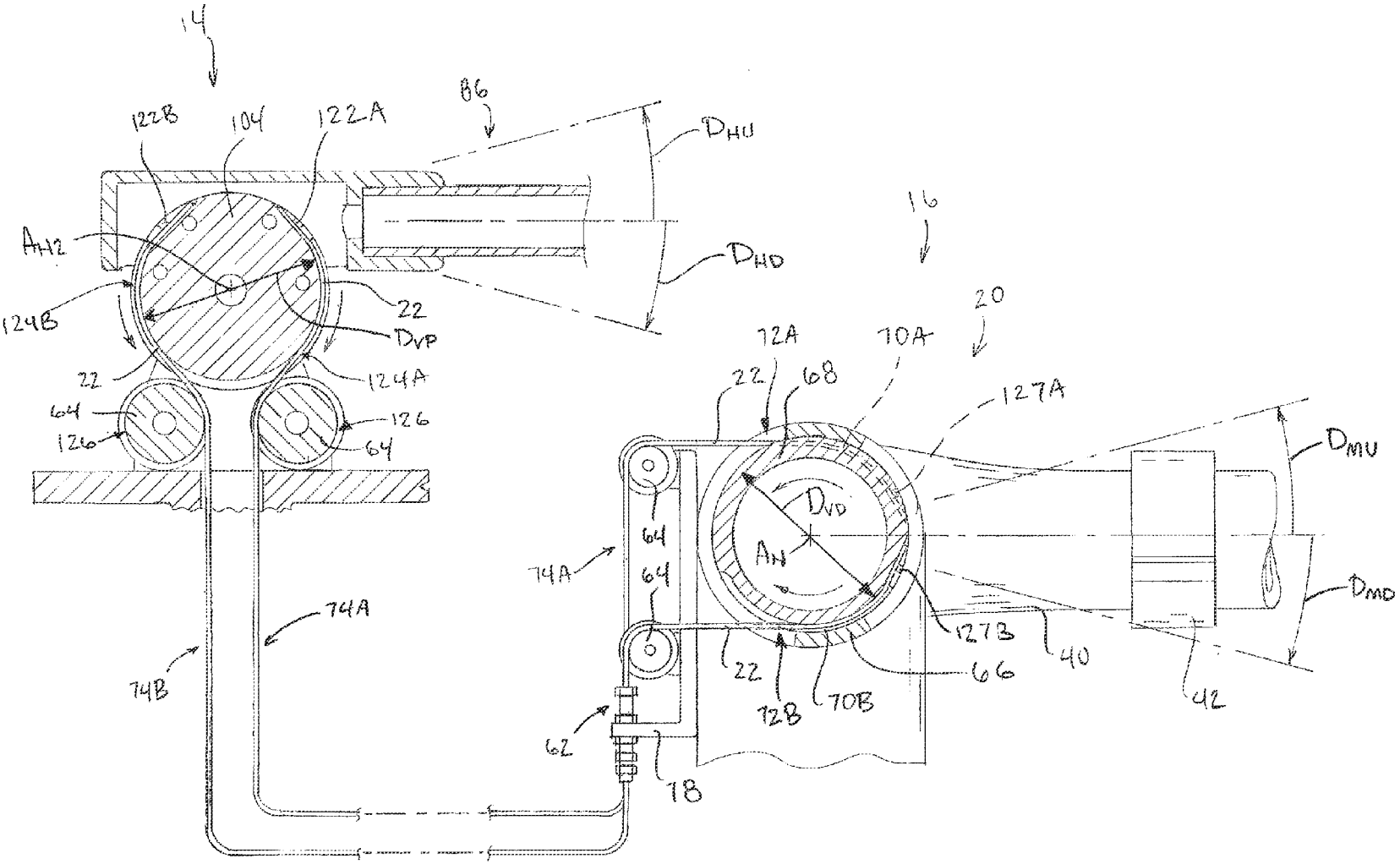
FIG. 8 is an elevation, schematic, cross-sectional view of the remote actuation system shown in FIG. 7.

Cable cores 22 are affixed at their respective distal ends to various attachment points 122A, 122B, 123A, 123B, 127A, 127B, 128A, 128B, as shown in FIGS. 8 and 10 and described in further detail herein. Because the ends of the associated cable housings 24 are fixed with respect to main body 112 of cable mounting assembly 62, moving main body 112 toward or away from a respective point of fixation of cable cores 22 has the effect of shortening or lengthening the total distance that must be spanned by cable cores 22, respectively. Thus, if the tension in cable core 22 is desired to be increased, threaded nuts 120 can be adjusted toward the output end of cable mounting assembly 62, which acts to shift main body 112 away from the associated cable core fixation point and causes an additional portion of cable core 22 to be extracted outwardly from its respective cable housing 24. Conversely, if tension in cable core 22 is desired to be reduced, nuts 120 can be adjusted toward the input end of cable mounting assembly 62, which acts to shift main body 112 toward the associated cable core fixation point and allows a portion of cable core 22 to retreat into its respective cable housing 24.

In use, a remote operator can directly mechanically control the position, orientation and movement of monitor 20 by manually performing corresponding movements of control handle assembly 86. As described in detail below, both up-and-down and left-to-right movements can be performed, either individually or simultaneously to create a diagonal path.

Figure 7:
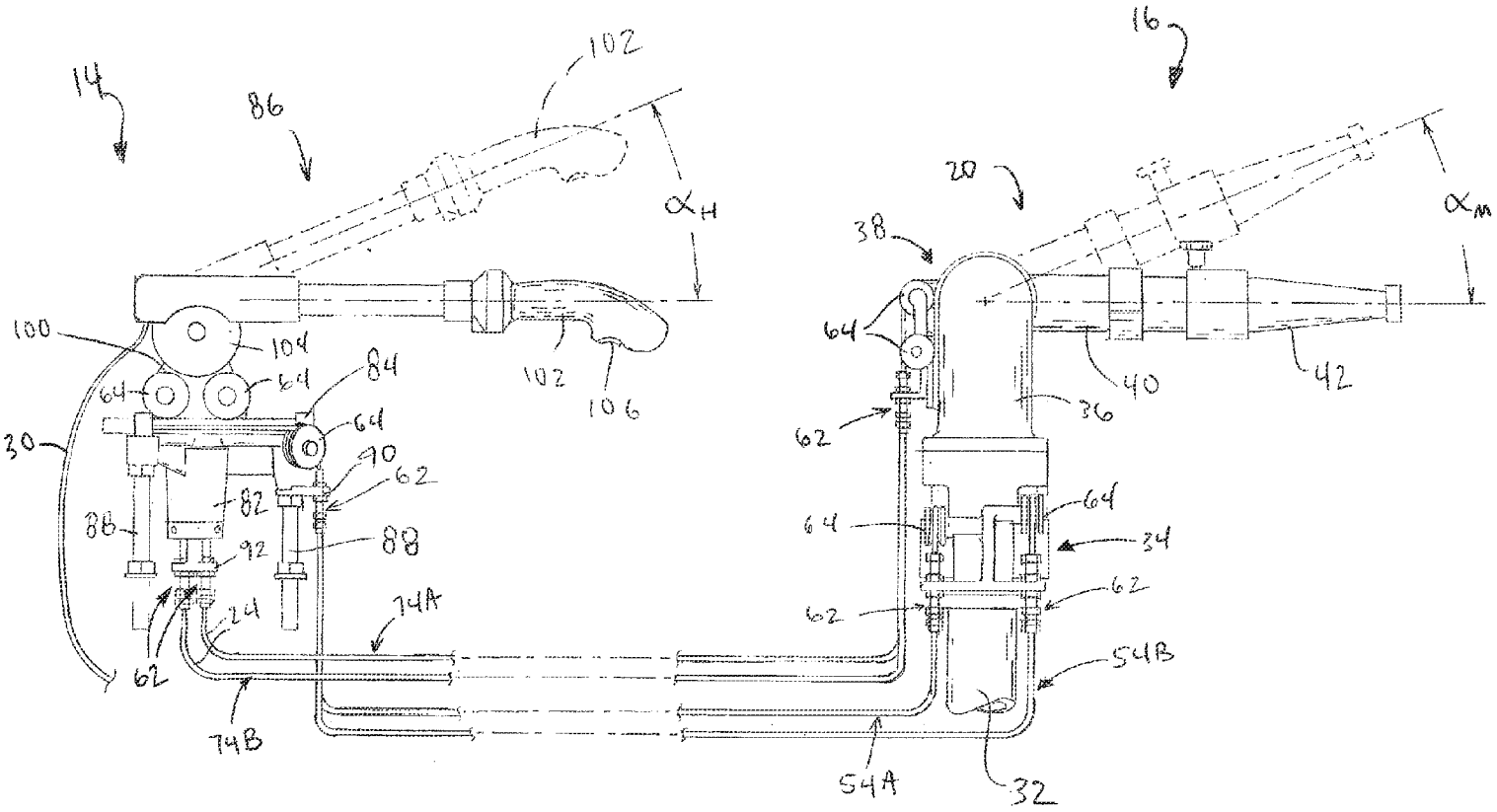
FIG. 7 is an elevation, schematic view of the proximal control mechanism of FIGS. 3A and 3B and the distal control mechanism of FIG. 2, illustrating correlation between up-and-down sweeping movements of the control handle and firefighting monitor.

Referring now to FIG. 7, an up-and-down movement of control handle assembly 86 is shown schematically in conjunction with a corresponding up-and-down movement of nozzle 42. As most clearly shown in FIG. 8, respective proximal terminal ends of cable cores 22 are affixed to opposing radial sides of barrel 104 at attachment points 122A, 122B, such as by set screws passing transversely from the outer sidewall of barrel 104, through grooves 124A, 124B, and into the material of barrel 104 toward horizontal axis $A_{H2}$ as illustrated. Each cable core 22 then passes around a portion of one of grooves 124A, 124B formed in the generally cylindrical sidewall of barrel 104, then into groove 126 of the adjacent pulley 64 as shown. Turning back to FIG. 7, cable cores 22 then unite with respective cable housings 24 at cable mounting assemblies 62, and down-adjustment cable 74B and up-adjustment cable 74A are routed to distal control mechanism 16 (e.g., along bumper 12 and into the cabin of engine 10 as shown in FIG. 1). Cable core 22 is then exposed at another pair of cable mounting assemblies 62, and routed around another pair of pulleys 64, through apertures 72A, 72B formed in outer sleeve 66, and into grooves 70A, 70B where the distal ends of cable cores 22 of cables 74A, 74B are respectively affixed at distal attachment points 127A, 127B (FIG. 8) of inner sleeve 68, such as by a set screw in similar fashion to attachment points 123A, 123B described above.

Referring to FIG. 8, when handle 102 is pulled upwardly along direction $D_{HU}$, barrel 104 rotates counterclockwise and tension is introduced into cable core 22 of up-adjustment cable 74A. This tension causes a concomitant, simultaneous counterclockwise rotation of inner sleeve 68, which in turn causes an upward sweep of elbow 40 and nozzle 42 along direction D. Conversely, when handle assembly 86 is moved downwardly along direction $D_{HD}$, barrel 104 rotates clockwise and tension is introduced into cable core 22 of down-adjustment cable 74B. This tension causes a concomitant, simultaneous clockwise rotation of inner sleeve 68, which in turn causes a downward sweep of elbow 40 and nozzle 42 along direction $D_{MD}$. Similarly to the discussion of the centering of nozzle 42 described above, nozzle 42 may be said to be vertically centered when the potential magnitude of $D_{MU}$ is the same as that of $D_{MD}$. In an exemplary embodiment, this centered orientation corresponds with a forward orientation of the outlet of nozzle 42. Handle 102 may also be forward-oriented and centered when nozzle 42 is centered, such that visual inspection of handle 102 from operator station 18 gives a positive indication of the orientation of nozzle 42.

Thus, the illustrated arrangement of up-and-down cables 74A, 74B allows selective tensioning of one of cable cores 22 to control up or down movement of monitor 20. More particularly, the respective cable cores 22 of up-and-down cables 74A, 74B are arranged at radially opposed portions of the cylindrical sidewall of barrel 104, and are wound around respective grooves 124A, 124B along opposite winding directions. As a result, rotation of barrel 104 about axis $A_{H2}$ (FIGS. 2 and 8) causes tension in one of cables 74A, 74B while simultaneously relaxing tension in the other of cables 74A, 74B. Moreover, long and flexible cables such as the Bowden cable arrangements of cables 74A, 74B are typically highly efficient at transferring force when in tension, but are substantially less efficient at transferring force by longitudinal compression. The present arrangement utilizing two cables (namely, cables 74A, 74B) for transmission of up-and-down movement of handle assembly 86 to monitor 20 takes advantage of the cables' ability to transmit force efficiently in tension by primarily using cable tension to transmit forces in each of the up and down directions of travel.

In the exemplary remote actuation system of FIG. 7, the angular sweep $\alpha_H$ through which the operator moves handle assembly 86 corresponds directly to the angular sweep $\alpha_M$ through which monitor 20 moves as a result. That is to say, a movement of handle assembly 86 away from a centered and/or forward orientation along up or down directions $D_{Hu}$, $D_{HD}$ (FIG. 8) correspondingly moves monitor 20 up or down away from its centered and/or forward orientation along directions $D_{MU}$ or $D_{MD}$, respectively, by nominally equal angular amounts $\alpha_M$ $\alpha_M$ respectively. This 1:1 ratio of angular up-and-down movement between proximal and distal control mechanisms 14, 16 results from setting the diameter $D_{VP}$ (FIG. 8) of grooves 124A, 124B at proximal control mechanism 14 the same as the diameter $D_{VD}$ (FIG. 8) of grooves 70A, 70B at distal control mechanism 16, respectively. Alternatively, it is contemplated that these groove diameters may be varied when a ratio of angular movement other than 1:1 is desired, as described in detail below with respect to the horizontal angular movement transmitted between proximal and distal control mechanisms 14, 16. In addition, it is contemplated that a cross-sectional profile of grooves 124A, 124B and/or grooves 70A, 70B may take a non-round shape as required or desired for a particular application. In effect, such a non-round shape can be expected to change the angular output movement of monitor 20 relative to a given angular input movement of handle assembly 86.

Figure 9:
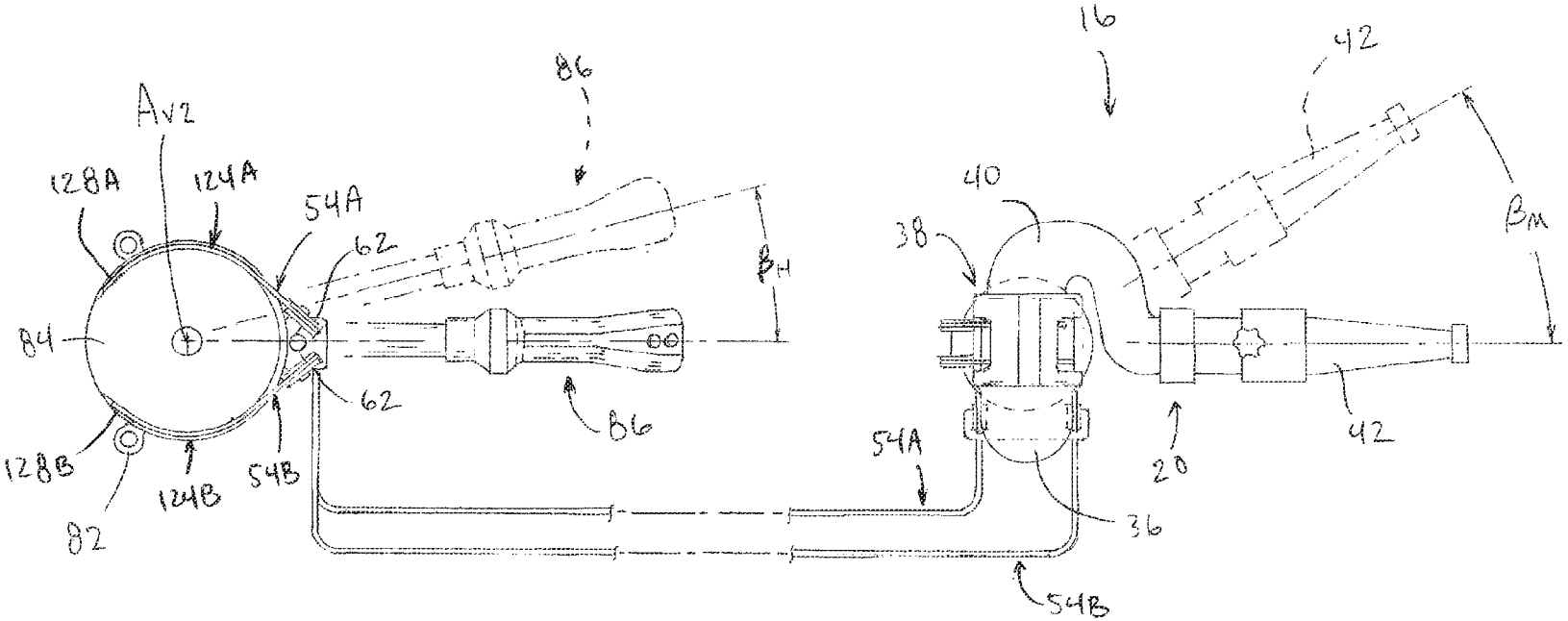
FIG. 9 is a plan, schematic view of the proximal control mechanism of FIGS. 3A and 3B and the distal control mechanism of FIG. 2, illustrating correlation between side-to-side sweeping movements of the control handle and firefighting monitor.

Transmitting side-to-side movement of handle assembly 86 into corresponding side-to-side movement of monitor 20 is accomplished in a similar fashion to the above-described up-and-down transmission of movement, and may be done as a separate movement or simultaneously with up-and-down movement. Referring now to FIG. 9, a side-to-side movement of control handle assembly 86 is shown schematically in conjunction with a corresponding side-to-side movement of nozzle 42 (together with elbows 36, 40 and second pivot coupling 38, as noted above). Proximal terminal ends of cable cores 22 of respective cables 54A, 54B are affixed to turntable 84 at respective attachment points 128A, 128B, such as by set screws extending transversely from the outer sidewall of turntable 84, through grooves 134A, 134B, and into the material of turntable 84 toward horizontal axis $A_{V2}$ as illustrated. These cable cores 22 each pass around respective portions of grooves 134A, 134B formed in the substantially cylindrical sidewall of turntable 84 in similar fashion to grooves 124A, 124B of barrel 104. Cable cores 22 of cables 54A, 54B then pass into grooves 126 of respective adjacent pulleys 64, as best seen in FIGS. 3A and 3B, and then route into cable mounting assemblies 62 and on to distal control mechanism 16.

At distal control mechanism 16, cable cores 22 again become available distal of cable mounting assemblies 62, and are routed around pulleys 64, through apertures 52A, 52B and into grooves 50A, 50B as shown in FIGS. 2 and 10 and described above.

Referring now to FIG. 10, when handle 102 is pulled sideways and left along direction $D_{HL}$, turntable 84 rotates counterclockwise (i.e., along a left-hand direction) and tension is introduced into cable core 22 of left-adjustment cable 54A. This tension causes a concomitant, simultaneous counterclockwise (i.e., left-hand) rotation of inner sleeve 48, which in turn causes a leftward, sideways sweep of nozzle 42 along direction $D_{ML}$ as noted above. Conversely, when handle assembly 86 is moved sideways and right along direction $D_{HR}$, turntable 84 rotates clockwise (i.e., along a right-hand direction) and tension is introduced into cable core 22 of right-adjustment cable 54B. This tension causes a concomitant, simultaneous clockwise (i.e., right-hand) rotation of inner sleeve 48, which in turn causes a rightward, sideways sweep of nozzle 42 along direction $D_{MR}$.

Similarly to the arrangement of up-and-down cables 74A, 74B described above, the dual-cable arrangement of side-to-side cables takes advantage of the ability of cable cores 22 to transmit force efficiently by using cable tension to transmit forces in both the right and left side-to-side directions of travel.

In the exemplary remote actuation system of FIG. 9, the angular sweep $\beta_H$ through which handle assembly 86 is moved equals one half of the corresponding angular sweep $\beta_M$ through which monitor 20 moves as a result. That is to say, when an operator moves handle assembly 86 away from a centered and/or forward orientation along left or right directions $D_{HL}$ or $D_{HR}$ (FIG. 8), the operator correspondingly moves monitor 20 away from the corresponding centered and/or forward orientation along left or right directions $D_{ML}$ or $D_{MR}$, respectively. The corresponding movement of monitor 20 by an angular amount $\beta_M$ is twice the angular movement $\beta_H$ of handle assembly 86. This 2:1 ratio of angular side-to-side movement between proximal and distal control mechanisms 14, 16 results from setting the diameter $D_{HP}$ (FIG. 10) of grooves 134A, 134B of turntable 84 at twice the nominal value of the diameter $D_{HD}$ (FIG. 10) of grooves 50A, 50B formed in inner sleeve 48 of first pivot coupling 34.

A remote actuation system in accordance with the present disclosure provides reliable, direct and intuitive control over a remote firefighting monitor. For example, a firefighter can manipulate proximal control mechanism 14 to sweep monitor 20 back and forth across a fire front with high precision and accuracy, thereby maximizing the effectiveness of a limited amount of firefighting fluid that may be available from the holding tank of engine 10 (FIG. 1). This manipulation of monitor 20 can be conducted with a level of ease and responsiveness on par with direct, manual manipulation of a monitor in the hands of the firefighter, while allowing the firefighter to remain in the relative safety of the cabin of engine 10. In addition, this precise and responsive manual functionality can be provided in a relatively low-cost system which minimizes or eliminates the need for electrical control apparatuses and components. Further, in configurations where monitor 20 may not be directly visible by the firefighter from operator station 18, the position and orientation of handle 102 offers visual confirmation of the corresponding position and orientation of monitor 20 without the necessity to discharge and observe a fluid stream.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A system for remotely directing a flow of firefighting fluid, the system comprising:

a firefighting monitor having a fluid inlet and a fluid outlet arranged to point in a first direction, the fluid outlet pivotable away from the first direction along a side-to-side monitor sweep and an up-and-down monitor sweep;

a control mechanism spaced from said firefighting monitor, said control mechanism including a handle positionable to point in the first direction and pivotable away from the first direction along a side-to-side control sweep and an up-and-down control sweep; and an arrangement of cables mechanically connected to said firefighting monitor and said control mechanism each of the cables including a cable housing disposed over a cable core, the cable core fixed to the firefighting monitor and the control mechanism and longitudinally moveable with respect to the cable housing, such that left and right movement of said handle along said side-to-side control sweep causes corresponding left and right movement of said firefighting monitor along said side-to-side monitor sweep, respectively, via said arrangement of cables, and such that upward and downward movement of said handle along said up-and-down control sweep causes corresponding upward and downward movement of said firefighting monitor along said up-and-down monitor sweep, respectively, via said arrangement of cables, said handle facilitates remote manual positioning and control of said monitor by a corresponding positioning and control of said handle with respect to the first direction.

2. The system of claim 1, wherein the arrangement of cables are of sufficient length to place the firefighting monitor at least six feet away from said control mechanism.

3. The system of claim 1, wherein said control mechanism comprises a proximal control mechanism, and said firefighting monitor is part of a distal control mechanism mechanically connected to said arrangement of cables, said proximal control mechanism comprising a turntable rotatable about a proximal vertical axis, said arrangement of cables comprising a pair of side-to-side cables fixed to respective opposing radial sides of said turntable, said distal control mechanism comprising a first pivot coupling including a first rotatable component rotatable about a distal vertical axis, said side-to-side pair of cables fixed to respective opposing radial sides of said first rotatable component, such that left-hand rotation of said turntable creates tension in one of said side-to-side pair of cables which in turn causes rotation of said first rotatable component along a left-hand direction, and right-hand rotation of said turntable creates tension in the other of said side-to-side pair of cables which in turn causes rotation of said first rotatable component along a right-hand direction.

4. The system of claim 3, wherein said proximal control mechanism and said distal control mechanism each include a pair of pulleys and a pair of cable mounting assemblies, said pulleys arranged to route said side-to-side cables toward said cable mounting assemblies.

5. The system of claim 3, wherein:

said proximal control mechanism further comprises a barrel rotatable about a proximal horizontal axis, said arrangement of cables comprising an up-and-down pair of cables fixed to respective opposing radial sides of said barrel, said distal control mechanism comprising a second pivot coupling including a second rotatable component rotatable about a distal horizontal axis, said up-and-down pair of cables fixed to respective opposing radial sides of said second rotatable component, such that upward rotation of said barrel creates tension in one of said up-and-down pair of cables which in turn causes rotation of said second rotatable component along an up direction, and downward rotation of said barrel creates tension in the other of said up-and-down pair of cables which in turn causes rotation of said second rotatable component along a down direction.

6. The system of claim 5, wherein said barrel is affixed to said handle, said upward rotation of said barrel effected by upward movement of said handle and downward rotation of said barrel effected by downward movement of said handle.

7. The system of claim 6, wherein said handle includes a trigger operable to selectively permit or prevent the flow of firefighting fluid from said firefighting monitor.

8. The system of claim 5, wherein said proximal control mechanism and said distal control mechanism each include a pair of pulleys and a pair of cable mounting assemblies, said pulleys arranged to route said up-and-down pair of cables toward said cable mounting assemblies.

9. The system of claim 8, wherein said pulleys are arranged to route said up-and-down pair of cables along respective vertical pathways that are equally spaced from the vertical axis.

10. The system of claim 9, wherein said pair of up-and-down cables are substantially symmetrically arranged with respect to the vertical axis.

11. The system of claim 9, wherein said pair of up-and-down cables are sufficiently close to the vertical axis to maintain a low level of tensioning of said pair of up-and-down cables during the side-to-side control sweep, the low level of tensioning below a range of elasticity of a steel cable core whereby the side-to-side control sweep causes no up or down movement of said monitor.

12. The system of claim 11, wherein said pair of up-and-down cables are each within less than one inch from the vertical axis.

13. The system of claim 5, wherein said barrel is rotatably attached to said turntable by a support extending upwardly from said turntable, such that said barrel is carried by said turntable and rotates about the proximal vertical axis when said turntable is rotated.

14. The system of claim 13, wherein said barrel defines a pivot point of rotation disposed proximate the proximal vertical axis.

15. The system of claim 14, wherein the pivot point of rotation is disposed on the proximal vertical axis.

16. The system of claim 1, wherein said cable core is exposed at proximal and distal ends of said plurality of cable assemblies for connection to said firefighting monitor and said control mechanism, said cable housing extending along a cable span between said firefighting monitor and said control mechanism.

17. A control mechanism for directing a flow of firefighting fluid, the mechanism comprising:

a base structure;

a turntable rotatably mounted to said base structure about a vertical axis, said turntable having a pair of side-to-side adjustment cables each including a cable housing disposed over a cable core longitudinally moveable with respect to the cable housing, said cable cores affixed to opposing sides of a radial wall of said turntable, such that rotation of said turntable selectively tensions one of said cable cores of said pair of side-to-side adjustment cables;

a barrel rotatably mounted to said turntable by a support extending upwardly from said turntable, such that said barrel is carried by said turntable and rotates about the vertical axis when said turntable is rotated, said barrel rotatable about a horizontal axis and having a pair of up-and-down adjustment cables each including a cable housing disposed over a cable core longitudinally moveable with respect to the cable housing, said cable cores affixed to opposing sides of a radial wall of said barrel, such that rotation of said barrel selectively tensions one of said cable cores of said pair of up-and-down adjustment cables, said up-and-down adjustment cables arranged substantially symmetrically about the vertical axis; and a handle affixed to said barrel, such that said handle is moveable along a side-to-side direction to rotate said turntable, and said handle is moveable along an up-and-down direction to rotate said barrel.

18. The control mechanism of claim 17, further comprising a pair of turntable pulleys mounted to said base structure and disposed distal of said turntable, each of said pair of side-to-side adjustment cables engaged with one of said turntable pulleys.

19. The control mechanism of claim 17, further comprising a pair of barrel pulleys mounted to said turntable and disposed between said barrel and said turntable, each of said pair of up-and-down adjustment cables engaged with one of said barrel pulleys.

20. The control mechanism of claim 17, wherein:

said cable cores of said pair of side-to-side adjustment cables and said pair of up-and-down adjustment cables are connected to a remotely located firefighting monitor, and said selective tensioning of said cable cores of said side-to-side adjustment cables and said cable cores of said pair of up-and-down adjustment cables is operable to position the remotely located firefighting monitor in an orientation corresponding with the orientation of the handle.

21. The control mechanism of claim 20, wherein said handle includes a trigger operable to selectively permit or prevent the flow of firefighting fluid from said firefighting monitor.

22. The control mechanism of claim 17, wherein said up-and-down adjustment cables are arranged substantially parallel to said vertical axis.

23. The control mechanism of claim 22, wherein said up-and-down adjustment cables are each spaced from said vertical axis by less than one inch.

24. A method of manually adjusting the position and orientation of a firefighting monitor from a remote operator station, the monitor defining a centered monitor orientation, the method comprising:

moving a handle of a proximal control mechanism away from a centered handle orientation corresponding to the centered monitor orientation, said step of moving comprising sweeping the handle in one of a left handle direction, a right handle direction, an up handle direction and a down handle direction; and tensioning one of a plurality of cables by said step of moving the handle, said plurality of cables each including a cable housing disposed over a cable core longitudinally moveable with respect to the cable housing, said plurality of cables extending from the remote operator station to the firefighting monitor such that the tension imparted to one of said cable cores longitudinally moves the cable core within the cable housing to move the firefighting monitor away from the centered monitor orientation in one of: i) a left monitor direction where said handle is moved in the left handle direction; ii) a right monitor direction where said handle is moved in the right handle direction; iii) an up monitor direction where said handle is moved in the up handle direction; and iv) a down monitor direction where said handle is moved in the down handle direction.

25. The method of claim 21, wherein:

said step of tensioning comprises tensioning the cable core of an up-adjustment cable when said handle is moved in the up handle direction, said up-adjustment cable moving the firefighting monitor along the up monitor direction;

said step of tensioning comprises tensioning the cable core of a down-adjustment cable when said handle is moved in the down handle direction, said down-adjustment cable moving the firefighting monitor along the down monitor direction;

said step of tensioning comprises tensioning the cable core of a left-adjustment cable when said handle is moved in the left handle direction, said left-adjustment cable moving the firefighting monitor along the left monitor direction; and said step of tensioning comprises tensioning the cable core of a right-adjustment cable when said handle is moved in the right handle direction, said right-adjustment cable moving the firefighting monitor along the right monitor direction.

26. The method of claim 25, further comprising activating a trigger on the handle to selectively permit or prevent a flow of firefighting fluid from the firefighting monitor.

27. The method of claim 25, wherein said steps of moving the handle in the left handle direction and the right handle direction comprise rotating a turntable to which the handle is mounted about a vertical axis.

28. The method of claim 25, wherein said steps of moving the handle in the up handle direction and the down handle direction comprise rotating a barrel to which the handle is affixed about a horizontal axis.

29. The method of claim 25, wherein said steps of moving the handle in the left handle direction and the right handle direction comprises moving the handle through an angular sweep, the angular sweep smaller than a resulting, corresponding angular sweep of the firefighting monitor.

30. The method of claim 25, wherein said step of moving the handle of the proximal control mechanism comprises moving the handle in one of the left handle direction and the right handle direction, while simultaneously moving the handle in one of the up handle direction and the down handle direction.

31. The control mechanism of claim 17, wherein the horizontal axis of the barrel intersects the vertical axis of the turntable.

* * * * *